US005368187A

United States Patent [19]

Poncetta et al.

[11] Patent Number: 5,368,187

[45] Date of Patent: Nov. 29, 1994

[54] METHOD AND APPARATUS FOR DISPENSING MATERIALS FROM BLISTER PACKAGES

[76] Inventors: Stanley Poncetta, 21431 Columbus Ave., Cupertino, Calif. 95014; John V. Castaldo, 5848 Burchell Ave., San Jose, Calif. 95120; Peter G. Spence, 14685 Oka Rd., #25, Los Gatos, Calif. 95030

[21] Appl. No.: 4,876

[22] Filed: Jan. 19, 1993

[51] Int. Cl.[5] ..... B65D 83/00

[52] U.S. Cl. ..... 221/30; 221/88; 221/93; 221/197; 206/531; 206/538

[58] Field of Search ..... 221/30–32, 221/87, 88, 25, 197, 93, 95, 1; 206/532, 531, 534, 535, 538, 539; 414/412

[56] References Cited

U.S. PATENT DOCUMENTS

| | | | |
|---|---|---|---|
| 1,575,972 | 3/1926 | Cochran . | |
| 2,366,886 | 1/1945 | Van Tuyl . | |
| 3,199,489 | 8/1965 | Ruoss et al. | 206/531 |
| 3,279,651 | 10/1966 | Thompson . | |
| 3,737,026 | 6/1973 | Whiteear | 206/532 |
| 3,826,222 | 7/1974 | Romick . | |
| 4,037,339 | 7/1977 | Romick . | |
| 4,418,823 | 12/1983 | Romick . | |
| 4,616,890 | 10/1986 | Romick . | |
| 4,627,432 | 12/1986 | Newell et al. | 221/30 |
| 4,690,279 | 9/1987 | Hochberg . | |
| 4,905,866 | 3/1990 | Bartell et al. | 221/88 |
| 4,909,414 | 3/1990 | Heath . | |
| 4,958,891 | 9/1990 | Taylor et al. . | |
| 4,975,015 | 12/1990 | Harding . | |
| 5,009,561 | 4/1991 | Lombardino et al. . | |
| 5,038,968 | 8/1991 | Albetski . | |
| 5,082,113 | 1/1992 | Romick . | |
| 5,109,984 | 5/1992 | Romick . | |

FOREIGN PATENT DOCUMENTS

| | | | |
|---|---|---|---|
| 256876 | 11/1991 | Japan | 221/31 |

*Primary Examiner*—H. Grant Skaggs
*Attorney, Agent, or Firm*—Townsend and Townsend Khourie and Crew

[57] ABSTRACT

A dispenser and method for dispensing materials from a blister pack of one or more blister cards. A single blister card having a plurality of blisters thereon can be used with other blister cards in a stack. To dispense materials from the aligned blisters of stacked blister cards, a plunger is driven through a guide hole in a top plate and into aligned blisters of a stack of blister cards. In this way, a plurality of blisters can be quickly and cleanly opened. Thus, a plurality of medical pills can be liberated from the blisters and can easily gravitate to a collection region below the stack of blister cards. Several embodiments of the mount for the blister card stack is disclosed.

35 Claims, 9 Drawing Sheets

METHOD AND APPARATUS FOR DISPENSING MATERIALS FROM BLISTER PACKAGES

This invention relates to improvements in opening packages containing materials in blisters of packages or cards and, more particularly, to a dispenser and method of opening blister packs containing medicinal materials, such as pills.

BACKGROUND OF THE INVENTION

Many different types of materials and products of small size are carried in blisters of blister packs. These packs are made up of cardboard cards having one or more blisters extending outwardly from holes in such a card so that each blister forms a pocket which is normally closed by a foil or other cover over the hole. Each blister is typically made from a transparent plastic material which can be severed by a knife or other cutting tool to gain access to the materials carried by the blister itself.

Among the various products which have been found to be suitably packaged in blister cards are medicinal materials, more specifically, one or more pills in each blister of a blister card. Also, small hardware stems, such as nuts and bolts, can be packaged in blisters of a blister card. Generally, these blister cards have a number of holes in them which are closed by blisters above a bottom layer of foil material which can be easily severed. Also, the blister for each hole extends upwardly from the upper surface thereof. The blisters are opened by hand by pressing inwardly on each blister one-by-one by the use of the thumbs.

The opening of the blisters of a blister card becomes an arduous and time consuming task when a nurse, for instance, must manually open the blister packs for a number of patients during the period when medication, such as a single pill, is to be given to the patients. Distributing a number of pills to a patient presents a problem because of the large number of patients in a hospital ward which must be given a relatively large number of pills, such as two or more, at each dosage time, over a given time period. Thus, a need exists for improved apparatus and a method for dispensing of materials, such as medicinal materials, in a way to facilitate the delivery of one or more medicinal items to a patient yet minimize the time required on the part of a nurse or other attendant to deliver and dispense the items to a number of patients. The present invention satisfies this need.

Disclosures of apparatus and methods of dispensing materials are found in the following U.S. patents:

| U.S. Pat. No. | Name | Issue Date |
|---|---|---|
| 1,575,972 | Cochran | 03/09/1926 |
| 2,366,886 | Van Tuyl | 01/09/1945 |
| 3,279,651 | Thompson | 10/18/1966 |
| 4,690,279 | Hochberg | 09/01/1987 |
| 4,909,414 | Heath | 03/20/1990 |
| 4,975,015 | Harding | 12/04/1990 |
| 5,009,561 | Lombardino | 04/23/1991 |
| 5,038,968 | Albetski | 08/13/1991 |

SUMMARY OF THE INVENTION

The present invention is directed to a dispenser and method for dispensing materials, particularly medicinal materials, such as one or more pills, from a blister pack of one or more blister cards. A single blister card having a plurality of blisters thereon can be used by itself or with other blister cards in a stack. More specifically, a stack of blister cards can be more readily accommodated with the dispenser and method of the present invention than if the blisters of the cards were manually and individually opened.

A stack of blister cards is placed in a support having a top plate provided with guide holes therethrough which are alignable with the blisters in the stack of blister cards. To dispense materials from the aligned blisters of stacked blister cards, a plunger or other force applying device is driven through a guide hole in the top plate and into the aligned holes having blisters therebelow. In this way, a plurality of blisters in a column can be quickly and cleanly opened by virtue of the fact that the plunger has a cutting edge on the end which engages the blisters. Thus, the blisters as well as the foils which close the tops of the holes having the blisters in the cards are severed and thereby opened. Thus, a plurality of medical pills can be liberated from the opened blisters and can easily gravitate to a collection region below the stack of blister cards.

Several embodiments of the mount for the blister card stack is disclosed. Moreover, the arrangement of the guide holes in the top plate and in the blister cards can be of any suitable configuration, such as rectangular or circular. The blister cards can be quickly and easily put in a stack and the stack can be held together as a unit below the normal position of the plunger. Thus, the stack will be located so as to permit rapid dispensing of pills from the blisters of a blister card. The dispensed pills are collected in a chute from whence they are given to a patient as a medicinal dose.

DETAILED DESCRIPTION OF THE PREFERRED EMBODIMENTS

Figure 1:
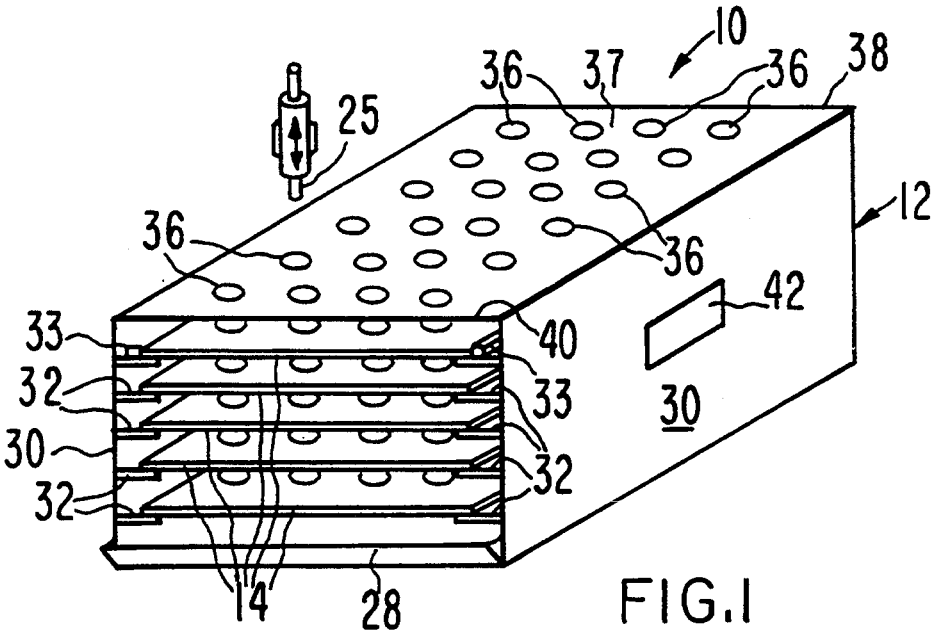
FIG. 1 is a perspective view, partially in schematic form, of the basic pill dispenser of the present invention, showing the guide holes in the top plate of the dispenser and the stacked pill-containing blister cards below the top plate for dispensing of pills from the blisters of the cards by the action of a plunger alignable with any one of the holes in the top plate.

The basic dispenser and a first embodiment of the present invention is broadly denoted by the numeral 10 (FIG. 1) and includes a support 12 which can be a housing, a frame, or any other suitable structure for mounting a plurality of blister cards 14 in a vertically stacked relationship as shown in FIG. 1. The cards 14 are shown in cross-section in FIG. 2 and each card 14 has a series of holes 15 which are arranged in columns and rows with each hole 15 having a plastic sheet or blister 17 for forming a pocket to contain a single pill 19 while foil layer 21 covers the opening 15 so that the pills remain in respective pockets, out of contact with the atmosphere.

While the present invention will hereinafter be described with respect to the dispensing of medical pills, it is possible that any type of granular or particle-like materials could be dispensed from dispenser 10, such as granular, powdered, or liquid materials. In all likelihood, liquid materials will probably not be used, but it is possible in some cases to dispense liquids, if desired or deemed necessary.

Figure 2:
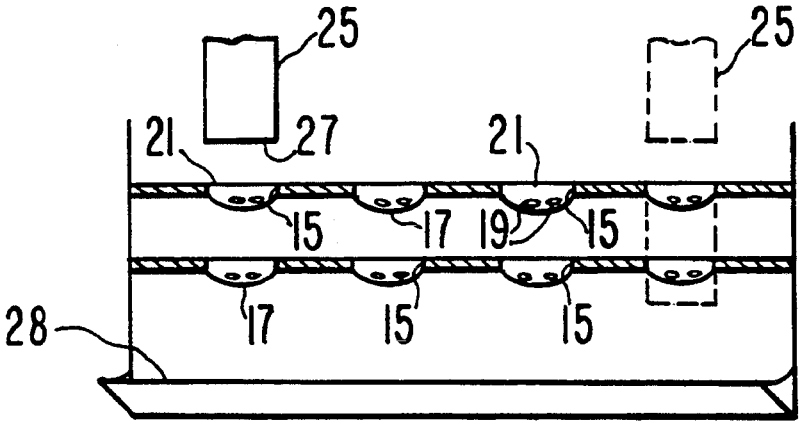
FIG. 2 is an enlarged, fragmentary cross-sectional view of two of the stacked blister cards showing that the blisters each contain a pair of pills with the blisters being vertically stacked and closed with a foil which is pierced by the plunger.

Cards 14 are typically of plastic or cardboard material. Thus, they are generally stiff and do not bend; however, the films 21 and the plastic blisters 17 are severable by a plunger or other type of cutter 25 which may or may not have a cutter blade 27 (FIG. 2) on the lower end thereof. The plunger can move relative to housing 12 either manually or by an x-y transfer machine (not shown). The plunger 25 can also be electromechanical in nature so that, as it is remotely shifted by operation of an x-y machine, it can also be remotely controlled by means of a switch directing signals to the plunger by way of a cable (not shown). Thus, when the plunger 25 is vertically aligned as shown in FIG. 2, with a column of aligned blisters 17, the plunger will descend and cut the film and the aligned blisters 17 so that one or more pills in the blisters will be free to fall and will so fall into a hopper or collector 28 below the stack of cards 14 as shown in FIGS. 1 and 2. The pills can then be removed from the collector 28 and given to and ingested by the patient. The blisters can be scored in some suitable manner to facilitate the opening of the blisters to liberate the pills therein.

The support 12 typically has a pair of side walls 30 provided with projections 32 extending inwardly from the side walls. Side walls 30 present shelves for supporting the side margins of blister cards in vertically stacked, parallel relationship as shown in FIG. 1. When so positioned, the holes in the columns of blisters 17 when stacked, are aligned with holes 36 in a top plate 37 forming the top margin of support 12.

As shown in FIG. 1, there are, for instance, four columns of holes 36 extending from a top edge 37 to a bottom edge 40. There are also eight rows of holes 36 with each row having four holes in it. Thus, there are a total of thirty two holes in plate 37 and there are corresponding thirty two holes 15 in cards 14 below plate 37. As one example, instead of thirty two holes in top plate 37, there could be thirty two holes. Thus, as one example, a thirty two hole unit would be suitable for dispensing pills for one month, even though a month has twenty eight, twenty nine, thirty, or thirty one days.

A label 42 (FIG. 1) can be put on the outside of one of the side walls 30 to give the name of the patient for whom the pills are intended and other information needed to verify proper dosage. Moreover, special instructions as to the number of pills to be given per day or at each dosage period can also be included on the label 42.

In use, blister cards 14 are mounted on shelves 32 in vertically stacked relationship as shown in FIG. 1. The shelves 32 will have alignment guides 33 (FIG. 1) to position the cards precisely with respect to each other so that the holes 15 of the various cards 14 are vertically aligned as shown in FIG. 2. At the beginning of the month, the first column of holes 15 are opened by moving the plunger 25 downwardly in guided relationship to a hole 36 and in cutting relationship to foil strips 21 and the blisters 17 as shown in FIG. 2. The full line position of the plunger 25 in FIG. 2 is the position assumed by the plunger before the plunger is moved downwardly. The dashed lines in FIG. 2 represent the path of travel of the plunger as it passes through a hole 36 in guide plate 37 and through the corresponding openings 15 of the various cards 14 to liberate the pills 19 in the various blister packs so that the pills can fall into and be collected by collector 28 from which these pills can be given to the patient in the normal fashion.

The housing and the stacked cards remain together with each other for a particular patient for a particular month, for example. However, other arrangements of cards 14 can be provided, in which case the dosage for each column of holes 15 of the various blister cards 14 can be for specific patients who are to be medicated once a day on the pills dispensed for a particular column. Thus, with the five stacked cards 14 in FIG. 1, a total of thirty two patients can be provided with pills for one twenty four hour period, assuming all of the pills from a particular column will be ingested by a particular patient for that day. At the end of the day, the cards 14 can be dispensed with or thrown away. A new set of cards 14 would then be put into place for dispensing of pills therefrom.

Each blister 17 of hole 15 can be initially scored with a line of weakness extending in a direction parallel to the lower edge of plunger 25. The preferred position of each blister 17 is shown in FIG. 2 with the blisters being below the upper surface of the blister card 14. However, the card may be reversible so that each blister 17 is above the upper surface of the card and above the film 21. Another aspect of the present invention is the fact that a card 14 can be removed from the stack and replaced by another card having different medication. Thus, medication can be added or deleted at any time. Unused medications are fully retrievable at any time.

Figure 3:
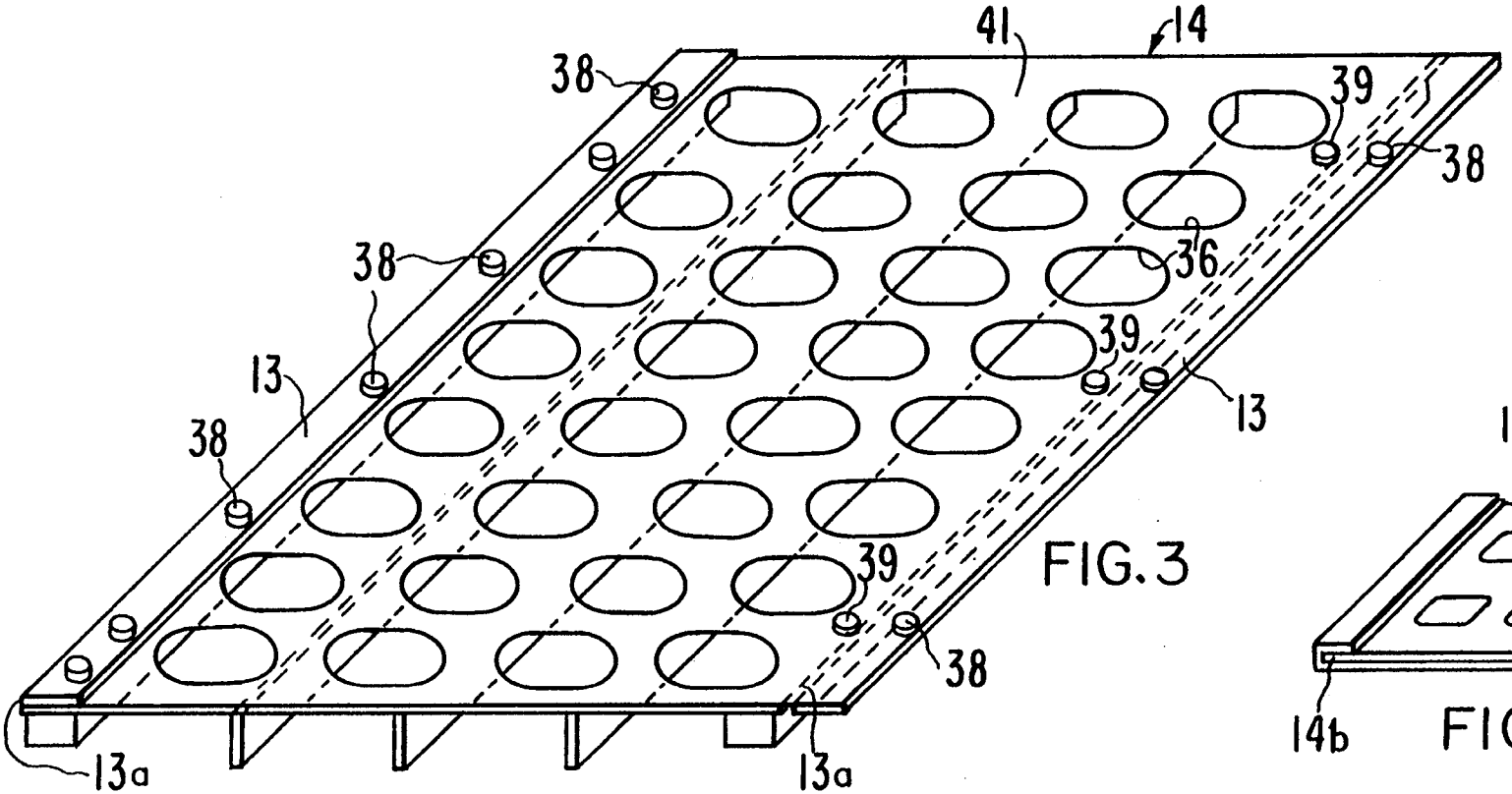
FIG. 3 is a perspective view of a first embodiment of the support frame for a blister card, showing the side rails for anchoring a blister card against movement relative to the support frame.
Figure 4:
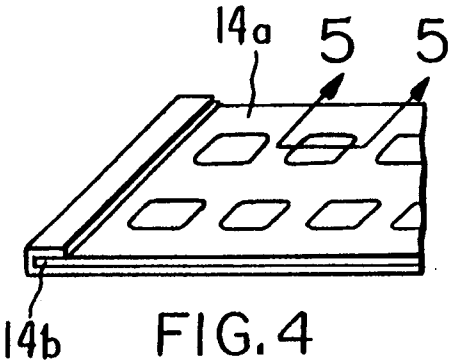
FIG. 4 shows a fragmentary, perspective view of a blister card held in place by the support frame of FIG. 3.

A preferred card mounting panel or support frame is denoted by the numeral 11 and is shown in FIGS. 3 and 4. Panel 11 has a pair of outer, relatively rigid strips 13 which are coupled by living hinges **13*a* (FIG. 6) to the main panel body of panel 11, whereby strips 13 can pivot or hinge about the pivot axis of each hinge 13***a* to thereby close the space between strip 13 and upper surface 41.

FIG. 3 shows the carrier panel 11 without the blister card 14*a* associated with panel 11; whereas FIG. 4 shows a blister card 14*a* which is secured by a side margin to carrier panel 11 by virtue of being clamped along the side margin 14*b* (FIG. 4) by the connection of buttons 38 with buttons 39 (FIG. 3). The buttons snap into place and can be separated by applying a manual force to the strip 13 near the vicinity of buttons 39.

Figure 5:
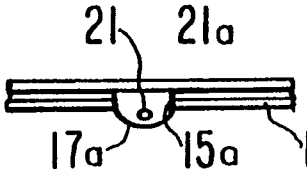
FIG. 5 is a cross-sectional view taken along line 5—5 of FIG. 4.

A review of FIG. 5 shows the upper panel 14*a* in juxtaposition to panel 11. In this sense, the blister pack 17*a* extends partially through a hole 15*a* in bottom panel 11. The blister 17*a* contains a pill 21 and is covered by a film 21*a*. A plunger (not shown) is used to open the blister pack by severing the film 21*a* and the plastic of blister 17*a*.

Figure 6:
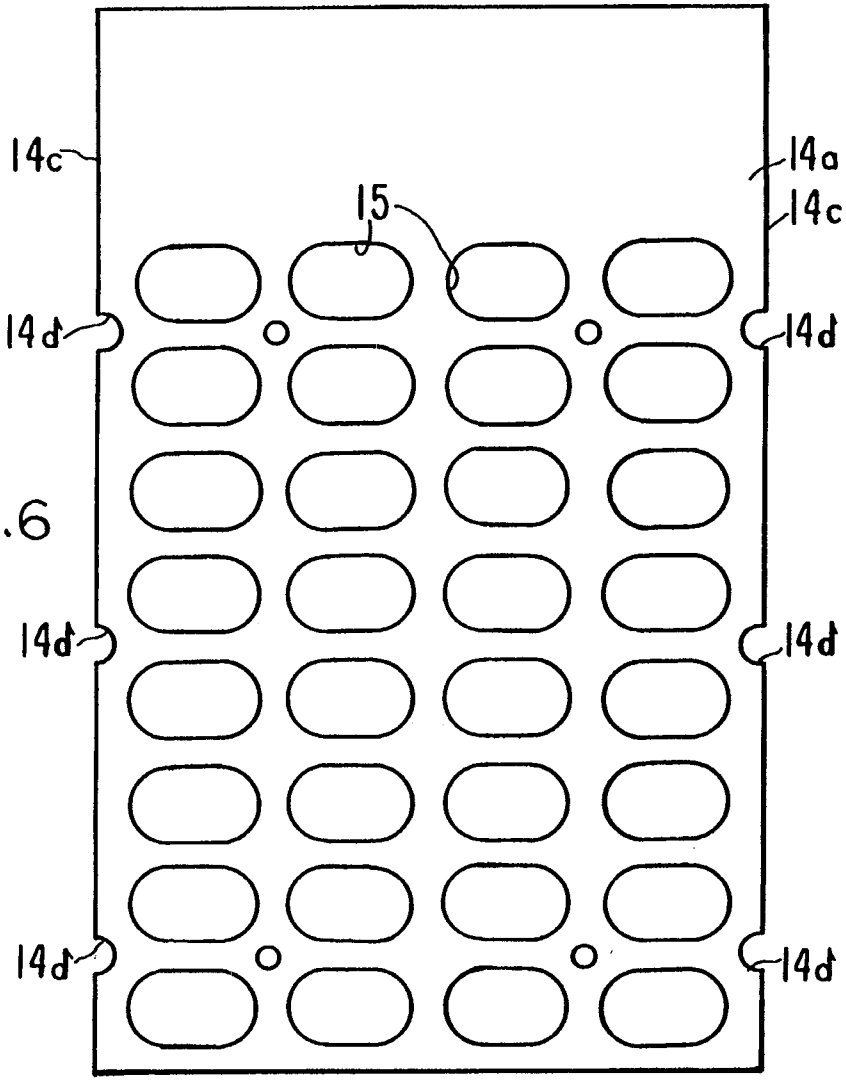
FIG. 6 is a plan view, on an enlarged scale, of the blister card showing the holes for the blisters and the film for covering the holes from above.

FIG. 6 shows a plan view of blister card 14*a*. The opposed side margins 14*c* of the blister card 14*a* has semicircular recesses 14*d* (FIG. 6) which engage the buttons or pins 39 (FIG. 3) to position the holes in card 14*a* in vertical alignment with the corresponding holes 36 in carrier panel 11.

Figure 8:
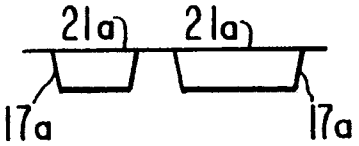
FIG. 8 is a cross-sectional view taken along line 8—8 of FIG. 6.
Figure 7:
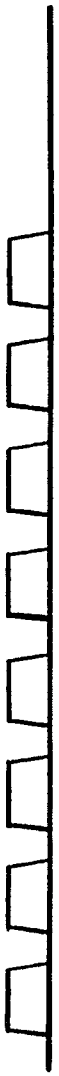
FIG. 7 is a vertical section through the blister card, taken along line 7—7 of FIG. 6.
Figure 9:
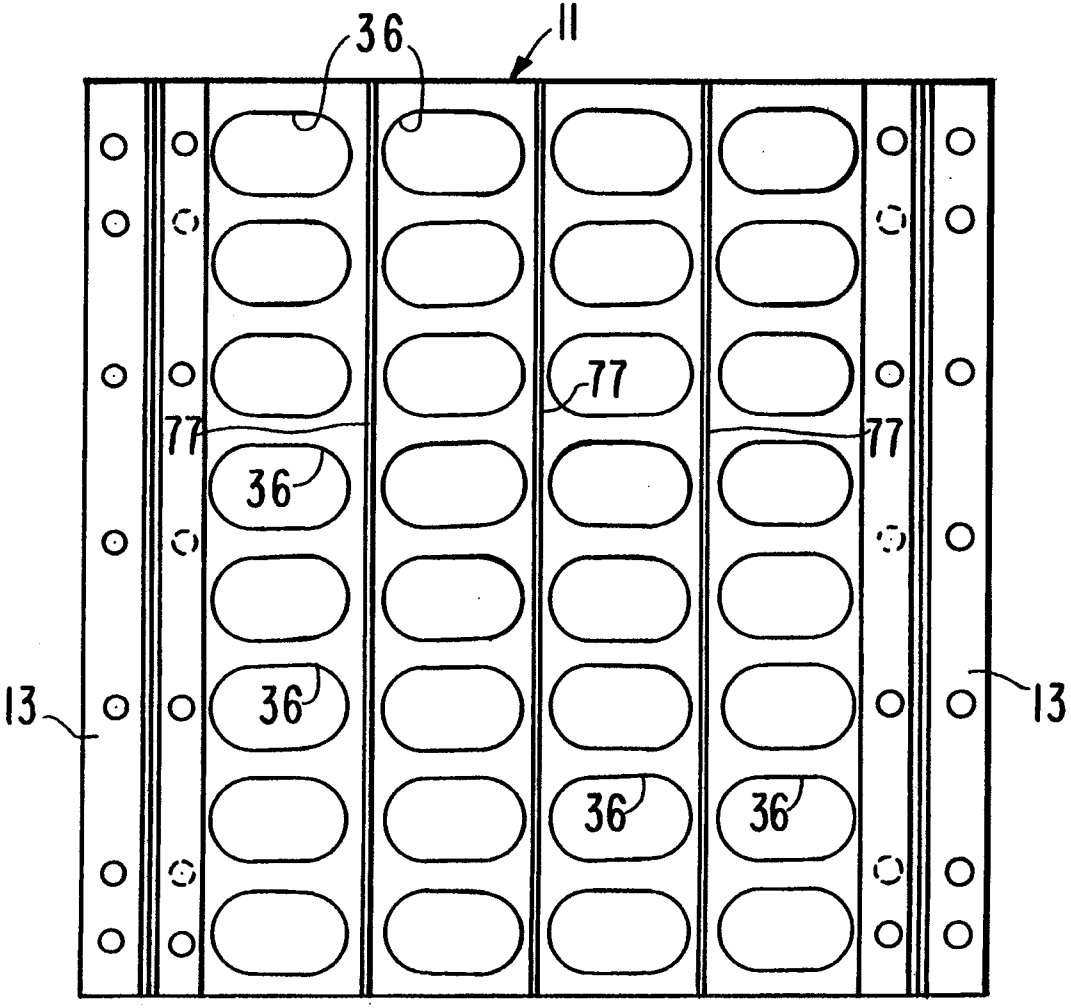
FIG. 9 is a bottom plan view of the support frame of the present invention.
Figure 10:
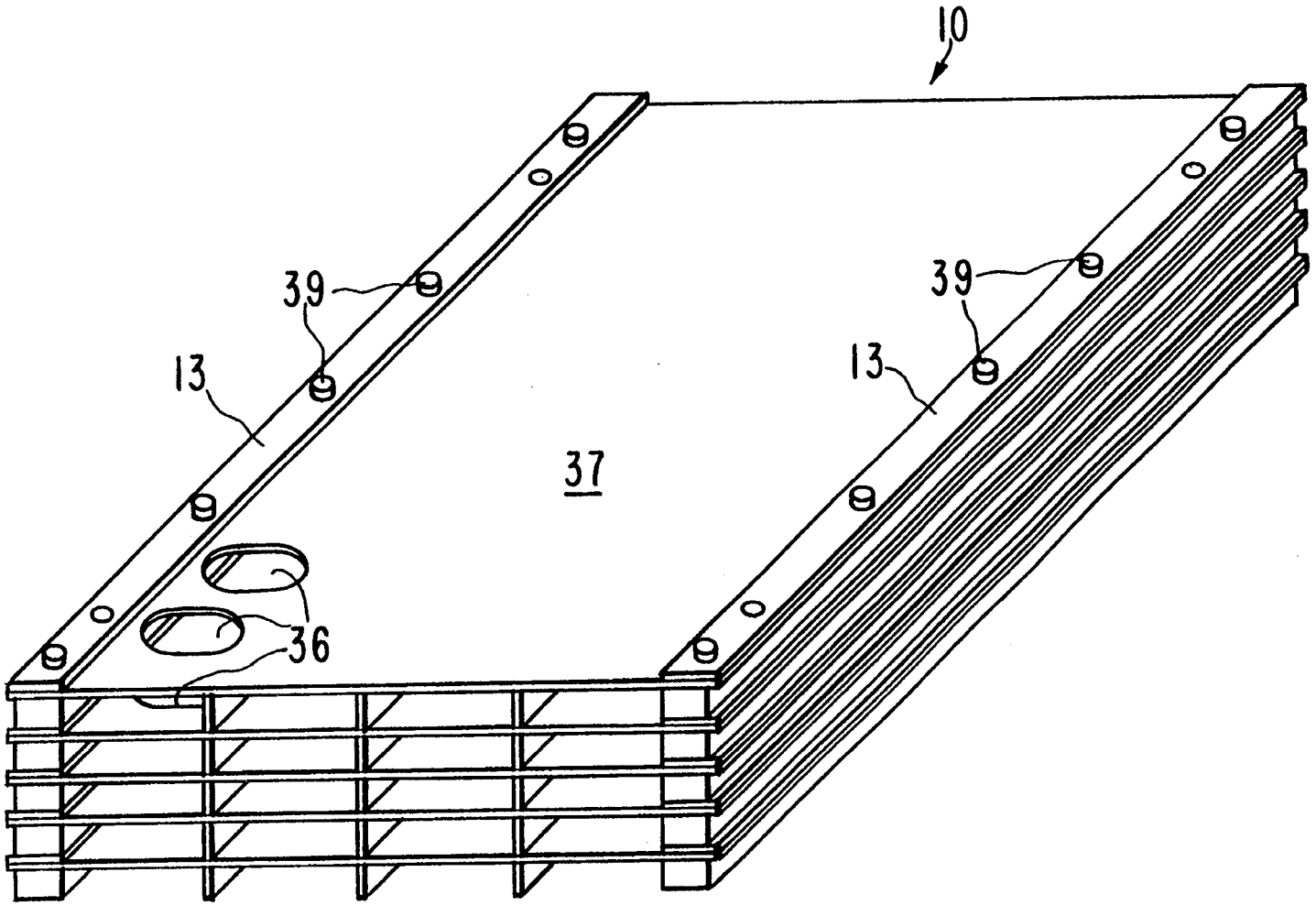
FIG. 10 is a perspective view of a stack of five support frames without the blister cards coupled thereto, showing the frames being locked together in a stacked relationship.

FIG. 8 shows the film 21*a* and the blister 17*a*. FIG. 9 is a view similar to FIG. 6 but showing the bottom of panel 11. A number of longitudinal support members 77 are secured to the underside of panel 11 in any suitable manner and the members run fore and aft. The purpose of the runners is to help in separating the adjacent carrier panels above and in the same stack in the manner shown in FIG. 10. FIG. 10 shows the carrier panels or support frames 11 stacked in place but without the blister cards 14 associated therewith.

Figure 11:
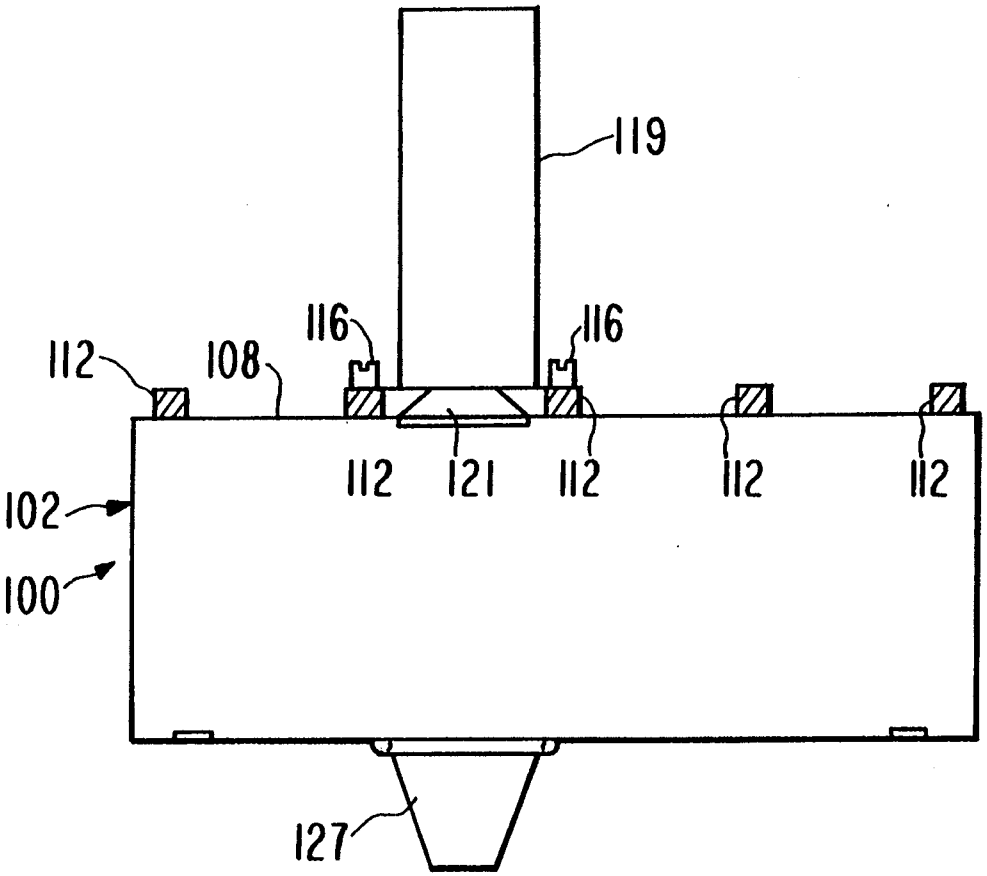
FIGS. 11 and 11A are end elevational and top plan views of the assembly of cards shown in FIG. 1, the stack of blister cards being shown schematically in a block form beneath a plunger which can be adjustably mounted at any location alignable with a column of holes in the blister stack.
Figure 11A:
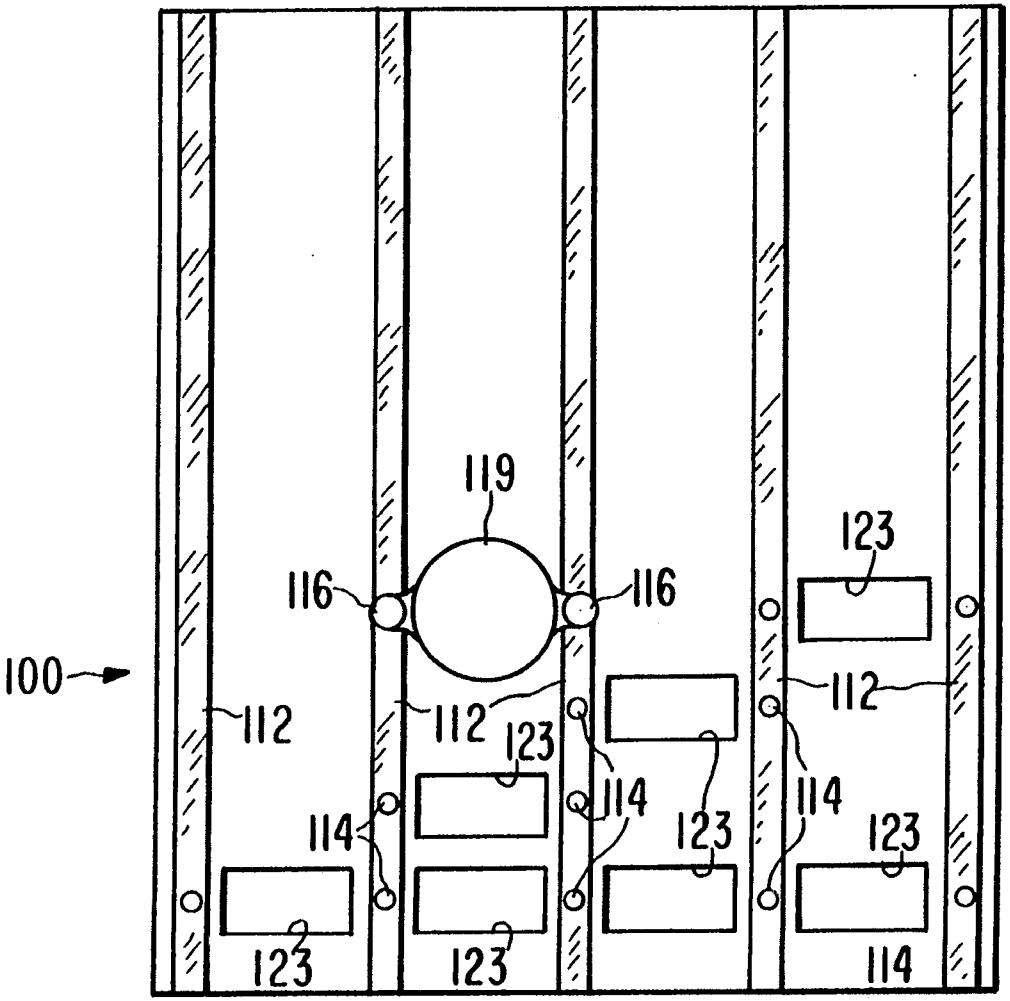

Another embodiment of the dispenser of the present invention is denoted by the numeral 100 and includes a housing, frame or support 102 which receives a stack 104 of blister cards shown schematically as a single block in FIG. 11. The top plate 108 of dispenser 100 has a number of parallel beams or elongated members 112 which are secured in any suitable manner at the ends thereof to housing 102. The rails have holes 114 for mounting of thumb screws 116 of a plunger mechanism 119 having a plunger 121 which enters holes 123 in the upper plate 108 for severing the blister packs of the blister cards in the stack identified by block 104. A collection cup 127 receives the liberated medication and the medication can be removed from collector cup 127, if desired.

To change the position of the punch 119, the punch is removed by separating thumb screws 116 from holes 114 and beams 116, then the punch is moved to a new location and the thumb screws anchor the punch press anew for punching the columns of medication in any particular column whereby the medication is collected.

Figure 12:
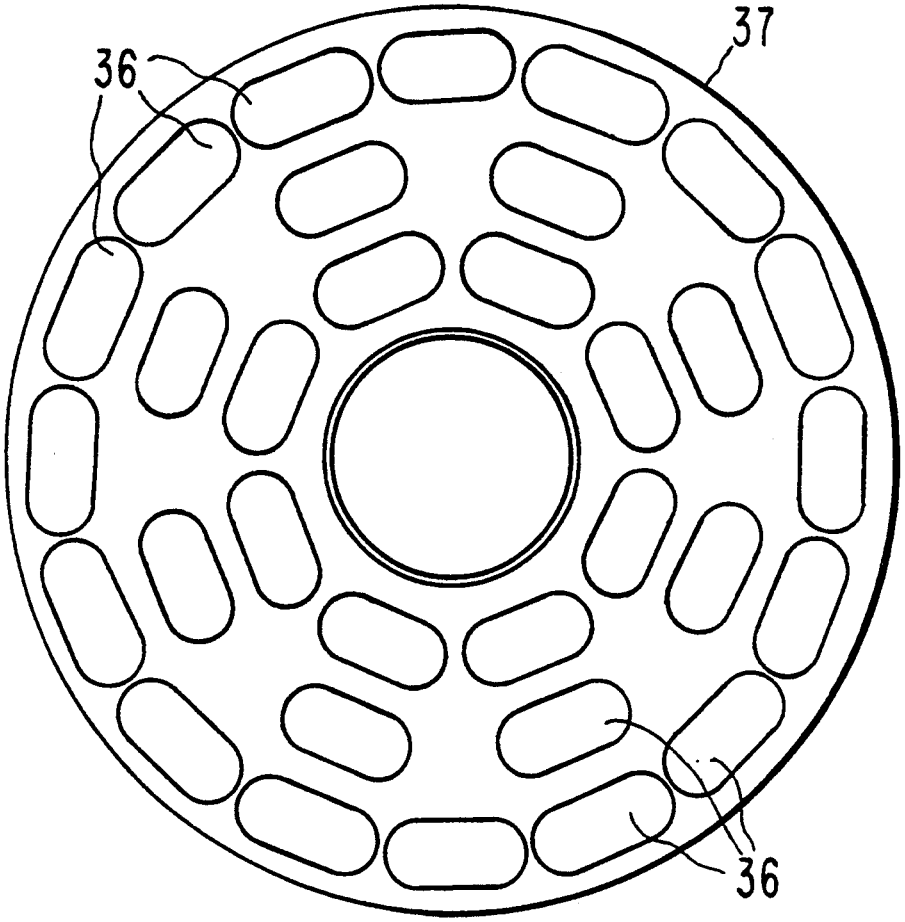
FIG. 12 is a top plan view of a circular blister card showing another embodiment of the way in which the pills can be dispensed from the blisters of such a card.
Figure 13:
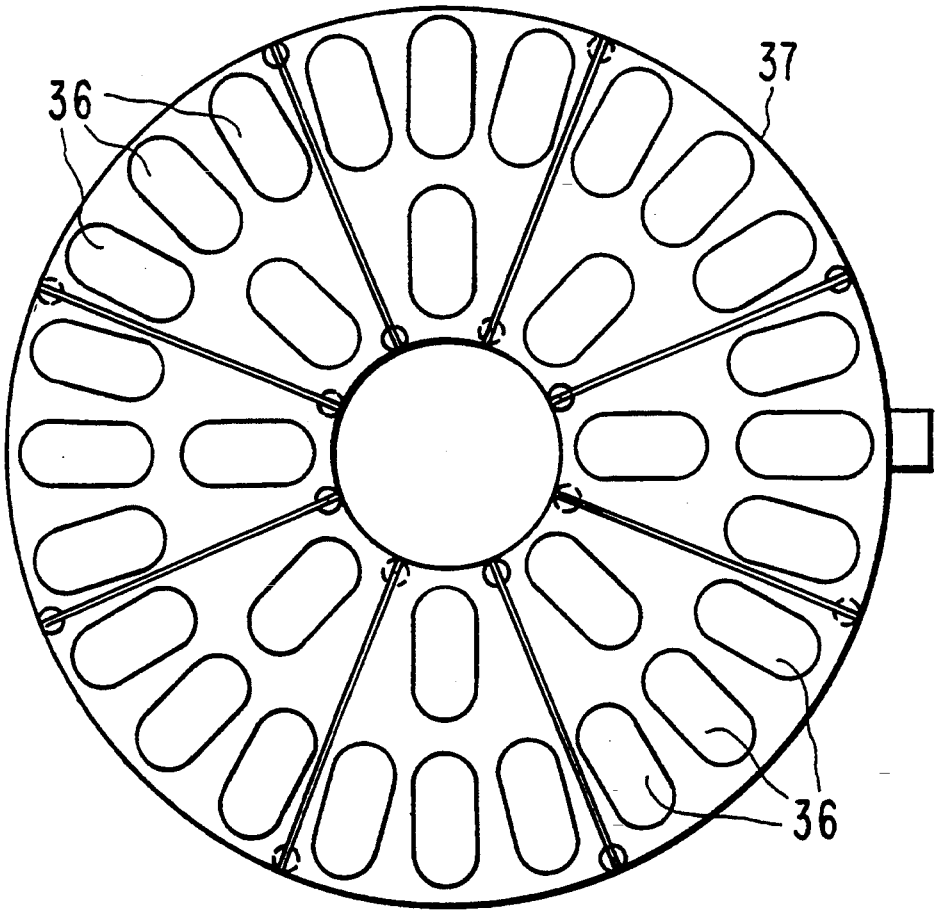
FIG. 13 is a view similar to FIG. 12 but showing the foil layer on one half of the area of the blister card.

The foregoing description has been made with respect to a top plate of generally rectangular configuration with the holes of the top plate being in rows and columns. Another and preferred embodiment of a top plate is shown in FIG. 12 and is circular in design. It is mounted in some suitable manner so as to position one or more blister cards 14 below the holes 36 in the top plate. A suitable punch or plunger (not shown) can be moved relative to the top plate and into overlying relationship to one of the holes thereof. By actuating the plunger and causing it to move downwardly with respect to the top plate, the plunger will break the foil seal and a corresponding blister at each of a number of elevations below the top plate and the liberated medicinal materials from the blister will fall into a chute or collector from which the materials can be removed for ingestion by a patient.

We claim:

1. A dispenser for materials carried in blisters in a blister card comprising:

a support having a means defining a plurality of spaced guide holes therethrough;

means coupled with the support for mounting a stack of blister cards below the defining means with each blister card having blisters substantially aligned with respective holes of said defining means;

means for applying a downward force to any group of aligned blisters of said blister cards to open the blisters of said group so as to allow the materials therein to be liberated therefrom; and means below the mounting means for the blister cards for receiving and collecting the materials liberated from a blister group.

2. A dispenser as set forth in claim 1, wherein said defining means includes a rectangular top plate and the holes in the top plate are in rows and columns.

3. A dispenser as set forth in claim 1, wherein the defining means includes a top plate having holes substantially located on a circumferential line and being of substantially the same size and shape as the holes in the blister card.

4. A dispenser as set forth in claim 1, wherein said mounting means includes a pair of shelves on the support for the side margins of each blister card, the side margins of the blister card adapted to be supported by the shelves.

5. A dispenser as set forth in claim 4, wherein is included a guide element on each shelf, respectively, for guiding the corresponding blister card to align the holes thereof vertically with the holes of the defining means.

6. A dispenser as set forth in claim 5, wherein said support includes a housing having a pair of opposed side walls, said shelves being on the inner surfaces of the side walls.

7. A dispenser as set forth in claim 6, wherein the shelves extend inwardly of the space between the side walls and the shelves are generally coplanar with respect to each other.

8. A dispenser as set forth in claim 1, wherein said collection means includes a chute for receiving the liberated materials, said chute being below the blister card when the latter is mounted below the defining means.

9. A dispenser as set forth in claim 1, wherein said force applying means includes a plunger movable into and out of alignment with any one of the holes of the defining means.

10. A dispenser as set forth in claim 9, wherein said plunger is manually actuated.

11. A dispenser as set forth in claim 9, wherein said plunger is electromechanically actuated.

12. A dispenser for materials comprising:

a support having means defining a plurality of spaced holes;

means on the support for mounting a plurality of stacked blister cards at a location below the defining means, each blister card adapted to be provided with the same number of holes as the number of holes in the defining means with the holes of the blister cards being aligned with corresponding holes in the defining means when the stack of blister cards is in said location;

means adjacent to the support and above the defining means for breaking the blisters of the holes of the defining means blister cards aligned with one of the holes of the defining means to liberate the materials in the opened blisters; and means below the stack of blister cards for receiving the liberated materials.

13. A dispenser as set forth in claim 12, wherein is provided a frame for each blister card, respectively, the frames having means for holding the cards in a vertical stack when the blister cards are coupled with individual, respective frames.

14. A dispenser as set forth in claim 13, wherein each frame includes a panel provided with holes therein, there being the same number of holes as the corresponding blister card, the blisters of the blister card being received within the holes of the corresponding panel, and means at the side margins of each panel for mounting the corresponding blister card thereto.

15. A dispenser as set forth in claim 14, wherein said mounting means includes a pair of side bars and means hingedly mounting the side bars to the panel.

16. A dispenser as set forth in claim 15, wherein said hinge is a living hinge, the panel being integral with the side bars and the hinges.

17. A dispenser as set forth in claim 15, wherein the side bars overly the side margins of the corresponding blister card when the latter is captured by the side bars of the corresponding panel, and button means for holding the side bars in said overlapping positions thereby coupling the frame with the blister card.

18. A dispenser as set forth in claim 17, wherein the frame has spaced pins thereon and the blister card has side recesses to receive respective pins to thereby guide the blister card into position on the frame before the side bars are pivoted into place overlying the side margins of the blister card.

19. A dispenser as set forth in claim 15, wherein is included button means snap-fitted together to form a stack of blister cards and frames when the blister cards are captured by the side bars of respective frames.

20. A dispenser as set forth in claim 14, wherein each panel has a bottom surface provided with a plurality of parallel rails extending downwardly therefrom for stiffening the panel.

21. A dispenser as set forth in claim 20, wherein the rails extend along the holder between the adjacent columns of holes therethrough.

22. A dispenser as set forth in claim 14, wherein is included a number of rails on a top wall of the support, said rails having means for releasably holding said force applying means to the rail in alignment with respective holes in the frame to thereby anchor the force applying means as a downward force is applied thereby to the blisters of the blister cards having holes aligned with the respective holes of the frame.

23. A dispenser as set forth in claim 12, wherein said defining means includes a top plate, the holes through the top plate being arranged in rows and columns.

24. A dispenser as set forth in claim 12, wherein said defining means includes a circular top plate, said holes in the top plate being in circumferentially spaced locations in the top plate.

25. A method of dispensing materials contained in severable blisters in a group of blister cards with each card having a hole therethrough for each blister, respectively, and the hole being covered by a foil, said method comprising:

providing a perforate zone above said group of cards, with the zone having a plurality of guide holes therethrough and with the number of holes being at least equal to the number of holes in each blister card;

positioning each blister card adjacent to the zone with each hole of the blister card being aligned with at least certain of the holes in the zone;

directing a force into and through a hole in the blister card to sever the blister and liberate the materials therein, as a hole of the zone guides the force through the blister; and collecting the materials after the blister has been severed.

26. A method as set forth in claim 25, wherein said materials are medicinal materials.

27. A method as set forth in claim 25, wherein said materials are particles.

28. A method as set forth in claim 25, wherein said materials are granular.

29. A method as set forth in claim 25, wherein said materials are liquids.

30. A method as set forth in claim 25, wherein said materials are identical to each other.

31. A method as set forth in claim 25, wherein the holes in the zone are arranged in rows and columns, the holes in the blister card being in rows and columns and alignable with respective rows and columns of the zone.

32. A method of dispensing of packaged materials comprising:

providing a plurality of blister cards with each card having a plurality of holes therethrough and a severable blister for one side of each hole, respectively, there being a severable cover closing the other side of each hole;

stacking the blister cards so that the various holes in the cards are in alignment with each other;

successively applying forces to the cards sufficient to sever the covers and the blisters of the cards so that the materials in the blisters will be successively liberated and will gravitate from the respective blisters; and collecting the materials at a location below the stack of blister cards.

33. A method of dispensing as set forth in claim 32, wherein said force applying step includes filling a set of aligned holes with a moving cutting medium as the holes of the cards are successively broken and severed to assure liberation of the materials in the various blisters.

34. A method of dispensing as set forth in claim 32, wherein is included the step of orienting the blister cards with respect to a predetermined reference so that respective holes in the cards will be in alignment with each other.

35. A method of dispensing as set forth in claim 32, wherein is included the step of removing the stack of blister cards and replacing them with a new stack after the first stack has been depleted of materials in the blisters thereof.

* * * * *